US007841826B1

(12) United States Patent
Phillips

(10) Patent No.: US 7,841,826 B1
(45) Date of Patent: Nov. 30, 2010

(54) SLAG REDUCTION PUMP

(75) Inventor: Harold Leon Phillips, Claremore, OK (US)

(73) Assignee: Wood Group ESP, Inc., Oklahoma City, OK (US)

( * ) Notice: Subject to any disclaimer, the term of this patent is extended or adjusted under 35 U.S.C. 154(b) by 819 days.

(21) Appl. No.: 11/726,445

(22) Filed: Mar. 21, 2007

Related U.S. Application Data

(60) Provisional application No. 60/796,629, filed on May 2, 2006.

(51) Int. Cl.
*F04D 29/44* (2006.01)

(52) U.S. Cl. ..... 415/121.1; 415/199.3; 415/901

(58) Field of Classification Search ..... 415/121.1, 415/901, 199.1, 199.2, 199.3, 198.1, 903, 415/121.2, 199.4, 199.5, 199.6; 417/423.9, 417/423.3

See application file for complete search history.

(56) References Cited

U.S. PATENT DOCUMENTS 1,387,660 A * 8/1921 Ostenberg ..... 415/901
2,670,686 A * 3/1954 Bergh ..... 417/423.3
3,961,758 A 6/1976 Morgan
4,781,531 A 11/1988 James
4,948,351 A 8/1990 Williams
4,981,420 A * 1/1991 Jensen et al. ..... 417/423.3
5,659,214 A 8/1997 Guardiani et al.
5,674,057 A 10/1997 Guardiani et al.
6,139,260 A * 10/2000 Arbeus ..... 415/121.2
6,361,272 B1 3/2002 Bassett
6,364,620 B1 4/2002 Fletcher et al.
6,481,973 B1 11/2002 Struthers
2005/0074331 A1 * 4/2005 Watson ..... 415/199.2

FOREIGN PATENT DOCUMENTS

JP 06323291 A * 11/1994

* cited by examiner

*Primary Examiner*—Richard Edgar
(74) *Attorney, Agent, or Firm*—Crowe & Dunleavy

(57) ABSTRACT

A grinder pump assembly includes at least one grinder pump stage that has a diffuser and an impeller. The grinder pump assembly also includes a diffuser cap that includes cap contact surfaces. The impeller includes a plurality of upper vanes and lower vanes. The diffuser includes a plurality of lower contact surfaces, a plurality of diffuser vanes and plurality of upper contact surfaces. The upper vanes of the impeller are configured to rotate in proximity with the lower contact surfaces on the diffuser. The lower vanes of the impeller are configured to rotate in proximity with the cap contact surfaces. Multiple grinder pump stages may be used within a single grinder pump assembly.

5 Claims, 5 Drawing Sheets

SLAG REDUCTION PUMP

RELATED APPLICATIONS

This application claims the benefit of U.S. Provisional Patent Application Ser. No. 60/796,629, entitled "Grinder Pump for Oil Well Fluids," filed May 2, 2006, the disclosure of which is herein incorporated.

FIELD OF THE INVENTION

This invention relates generally to the field of downhole pumping systems, and more particularly to a downhole pumping system well suited for pumping fluids with entrained solid particles.

BACKGROUND

Submersible pumping systems are often deployed into wells to recover hydrocarbons from subterranean reservoirs. Typically, a submersible pumping system includes a number of components, including an electric motor coupled to one or more pump assemblies. Production tubing is connected to the pump assemblies to deliver the hydrocarbons from the subterranean reservoir to a storage facility on the surface. Each of the components in a submersible pumping system must be engineered to withstand the inhospitable downhole environment.

The efficient recovery of hydrocarbons from wells depends on maintaining clean formations, casing perforations, lines and pumping equipment. Unfortunately, many oil wells produce fluids that contain large amounts of sold particles, or "slag," that are detrimental to downhole pumping components. Metallic slag often takes the form of iron sulfide particles of various sizes (0.0005" to 0.060" diameter) that are very hard (6-6.5 Mohs Scale). These and other particles tend to accelerate wear on downhole components as the solid particles are carried through the downhole pumping system with the produced fluid.

It is therefore desirable to prevent solid particles from contacting expensive components within the downhole pumping system. Despite the recognition of these problems, prior art attempts to protect downhole components from solid particles have proven ineffective or otherwise undesirable. It is to these and other deficiencies in the prior art that the present invention is directed.

SUMMARY OF THE INVENTION

In a preferred embodiment, the present invention provides a grinder pump assembly that includes at least one grinder pump stage and a diffuser cap. The grinder pump stage has a diffuser and an impeller. The impeller preferably includes a plurality of upper vanes and lower vanes. The diffuser preferably includes a plurality of lower contact surfaces, a plurality of diffuser vanes and a plurality of upper contact surfaces. The upper vanes of the impeller are configured to rotate in proximity with the lower contact surfaces on the diffuser. The lower vanes of the impeller are configured to rotate in proximity with contact surfaces on the diffuser cap. In alternate embodiments, multiple grinder pump stages are used within a single grinder pump assembly.

DETAILED DESCRIPTION OF THE PREFERRED EMBODIMENT

Figure 1:
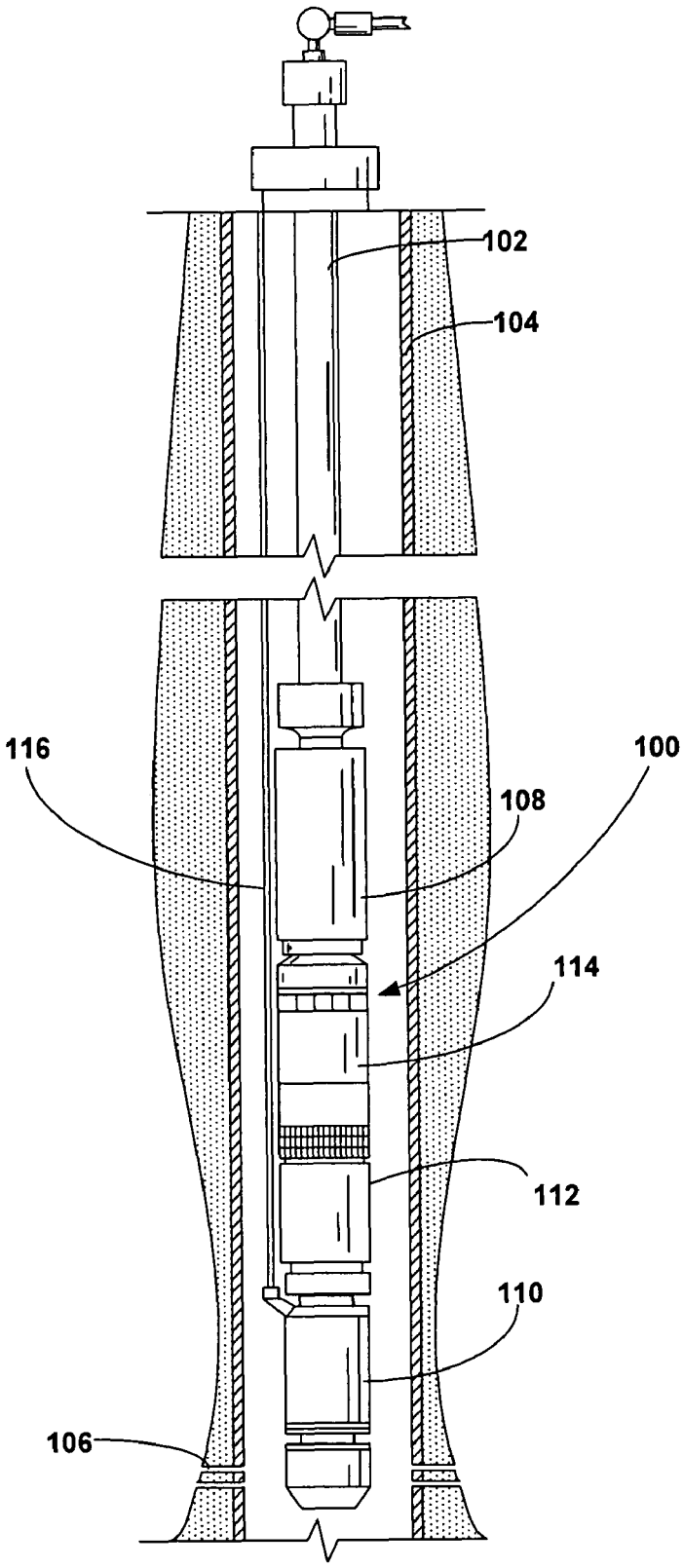
FIG. 1 is a diagrammatic view of an electric submersible pumping system disposed in a wellbore constructed in accordance with a preferred embodiment of the present invention.

In accordance with a preferred embodiment of the present invention, FIG. 1 shows an elevational, diagrammatic view of a pumping system 100 attached to production tubing 102. The pumping system 100 and production tubing 102 are disposed in a wellbore 104, which is drilled for the production of a fluid such as water or hydrocarbons. The production tubing 102 connects the pumping system 100 to a wellhead located on the surface. Although the pumping system 100 is primarily designed to pump hydrocarbon products, it will be understood that the present invention can also be used to move other fluids. The wellbore 104 preferably includes at least one set of perforations 106 through the wellbore 104 to permit the introduction of fluid from the producing geologic formations into the wellbore 104. The pumping system 100 is well-suited for deployment above the perforations 106 or in a "sumped" configuration below the perforations 106. Additionally, or in the alternative, the pumping system 100 can be employed in "open-hole" wells where a portion of the wellbore 104 is not cased.

The pumping system 100 preferably includes some combination of a primary pump assembly 108, a motor assembly 110, a seal section 112 and a grinder pump assembly 114. The seal section 112 prevents the entry of well bore fluids into the motor 110 and shields the motor assembly 110 from mechanical thrust produced by the primary pump assembly 108. The motor assembly 110 is provided with power from the surface by a power cable 116. Although only one primary pump assembly 108 and one motor assembly 110 are shown, it will be understood that additional pumps and motors can be connected within the pumping system 100 to meet the requirements of particular applications.

The grinder pump assembly 114 is preferably located between the seal section 112 and the primary pump assembly 108 such that the output of the grinder pump assembly 114 feeds the primary pump assembly 108. In this position, the grinder pump assembly 114 functions as an intake for the primary pump assembly 108. The grinder pump assembly 114 is configured to pulverize and reduce the size of solid particles entrained in the well fluid before the particles reach the primary pump assembly 108.

Figure 2:
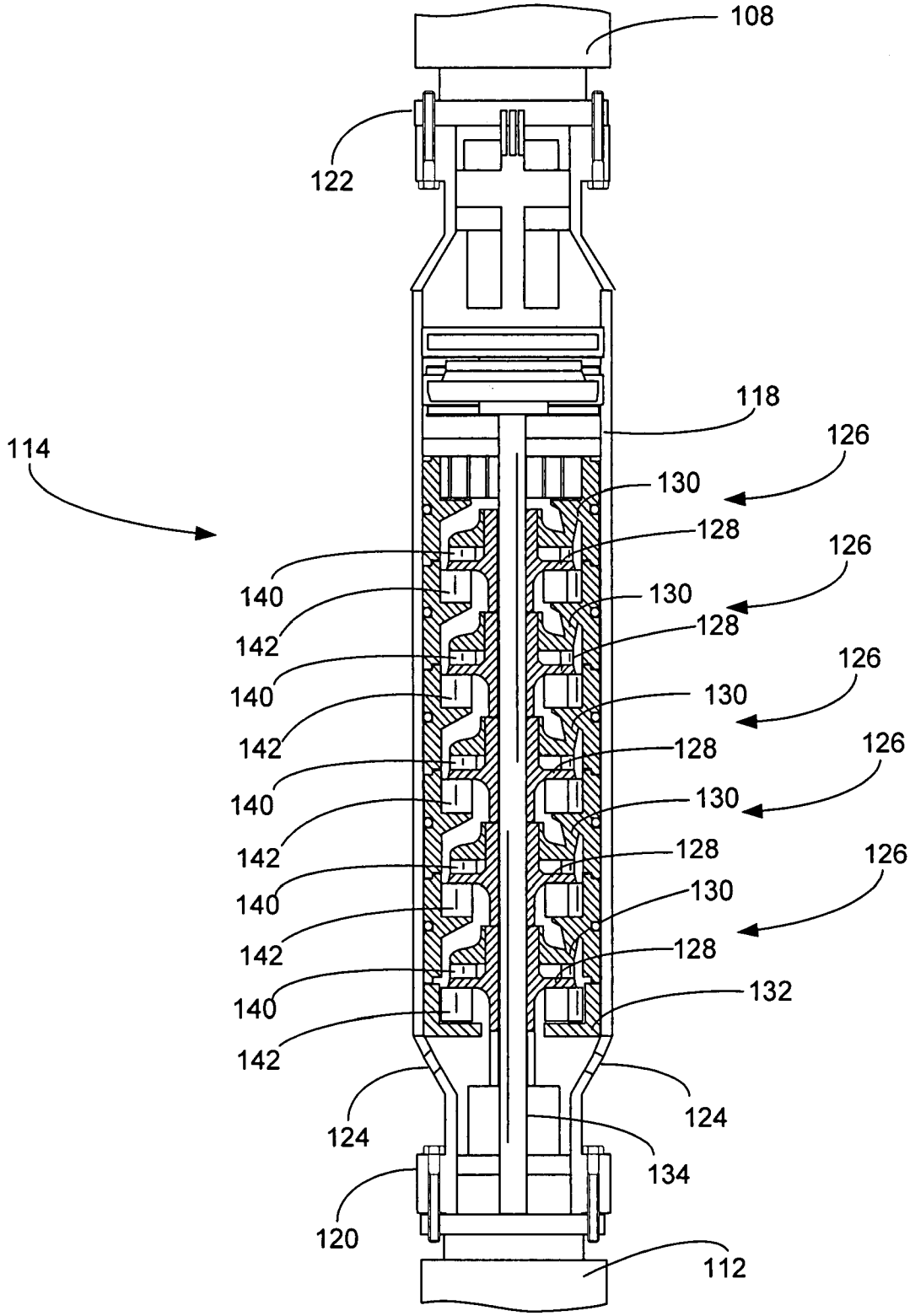
FIG. 2 is a side cross-section view of a grinder pump assembly constructed in accordance with a preferred embodiment of the present invention.

Turning to FIG. 2, shown therein is a side cross-sectional view of a preferred embodiment of the grinder pump assembly 114. The grinder pump assembly 114 preferably includes a housing 118, a base 120 and a head 122. In the preferred embodiment, the base 120 is connected to the seal section 112 and the head 122 is connected to the primary pump assembly 108. The housing 118 preferably includes a plurality of intake ports 124 proximate the base 120.

The grinder pump assembly 114 also includes at least one grinder pump stage 126. In a particularly preferred embodiment, the grinder pump assembly 114 includes a plurality of minder pump stages 126, as shown in FIG. 2. Each grinder pump stage 126 includes an impeller 128 and a diffuser 130. The grinder pump assembly 114 also preferably includes a diffuser cap 132 adjacent the upstream stage 126 and a shaft 134. The shaft 134 is preferably connected to shafts in the seal section 112 and primary pump assembly 108 (not shown) and configured for rotation when the motor 110 is energized.

The diffuser cap 132 and diffusers 130 are preferably locked in a stationary position relative the housing 118. In contrast, each of the impellers 128 are preferably keyed to the shaft 134 and configured for rotation relative the stationary diffusers 130. As each impeller 128 rotates, it imparts kinetic energy on the fluid to the wellbore. In accordance with well-known fluid mechanics, a portion of the kinetic force is transformed into pressure head by the downstream diffuser 130. In this sense, the grinder pump assembly 114 functions in as a multistage centrifugal pump.

Figure 3:
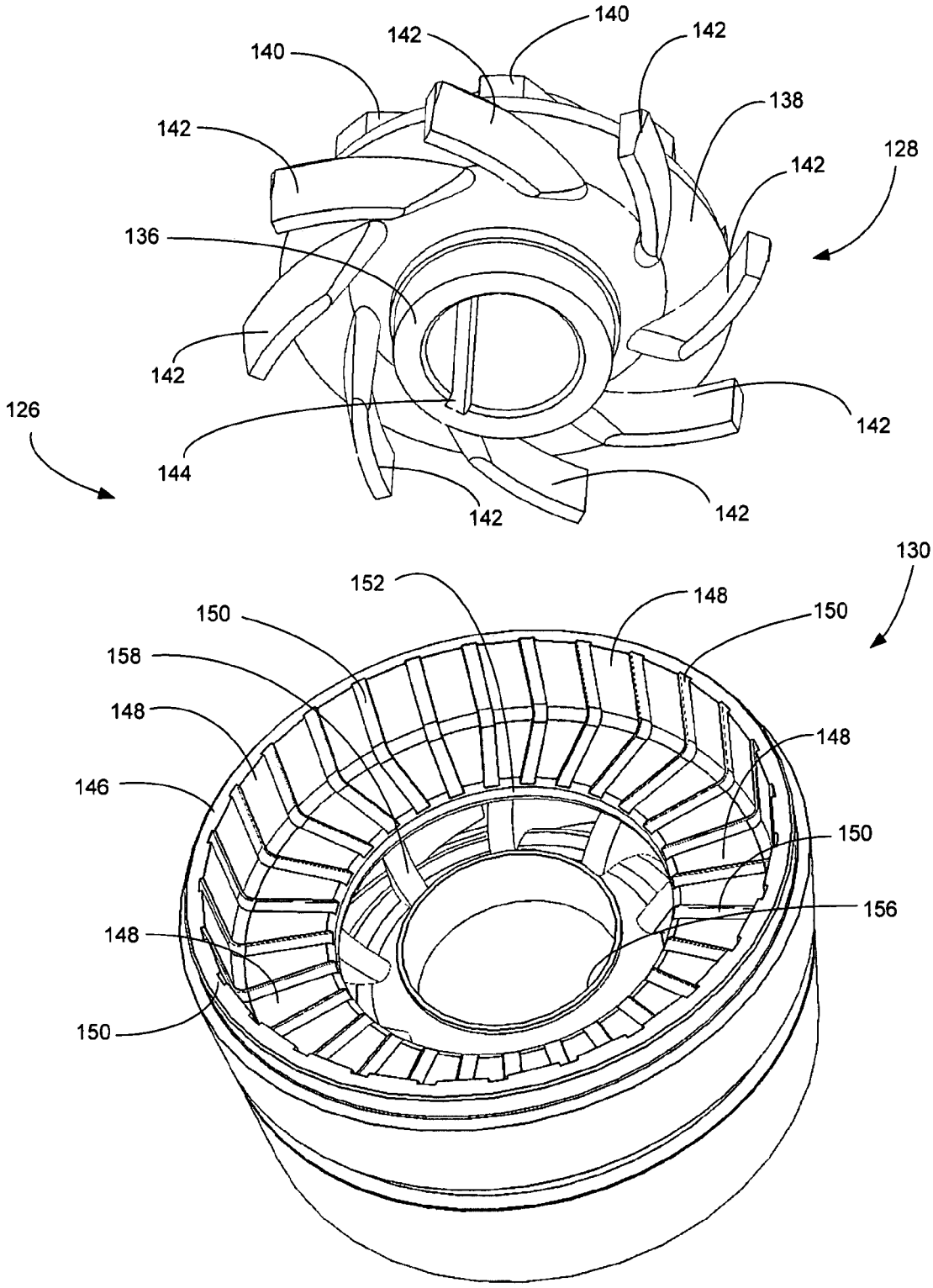
FIG. 3 is an exploded perspective view of the lower side of an impeller and the upper side of an adjacent diffuser of the grinder pump assembly of FIG. 2.

Unlike prior art centrifugal pumps, however, each impeller 128 and diffuser 130 is configured to pulverize solid particles entrained in the well fluid. Turning to FIG. 3, shown therein is an exploded perspective view of a grinder pump stage 126 showing the lower side of the impeller 128 and the upper side of the diffuser 130. It will be appreciated that references to "upper" and "lower," and "top" and "bottom," as used herein, are used solely for explanatory purposes and should not be construed to limit the overall disposition or orientation of the grinder pump assembly 114 or pumping system 100.

Figure 4:
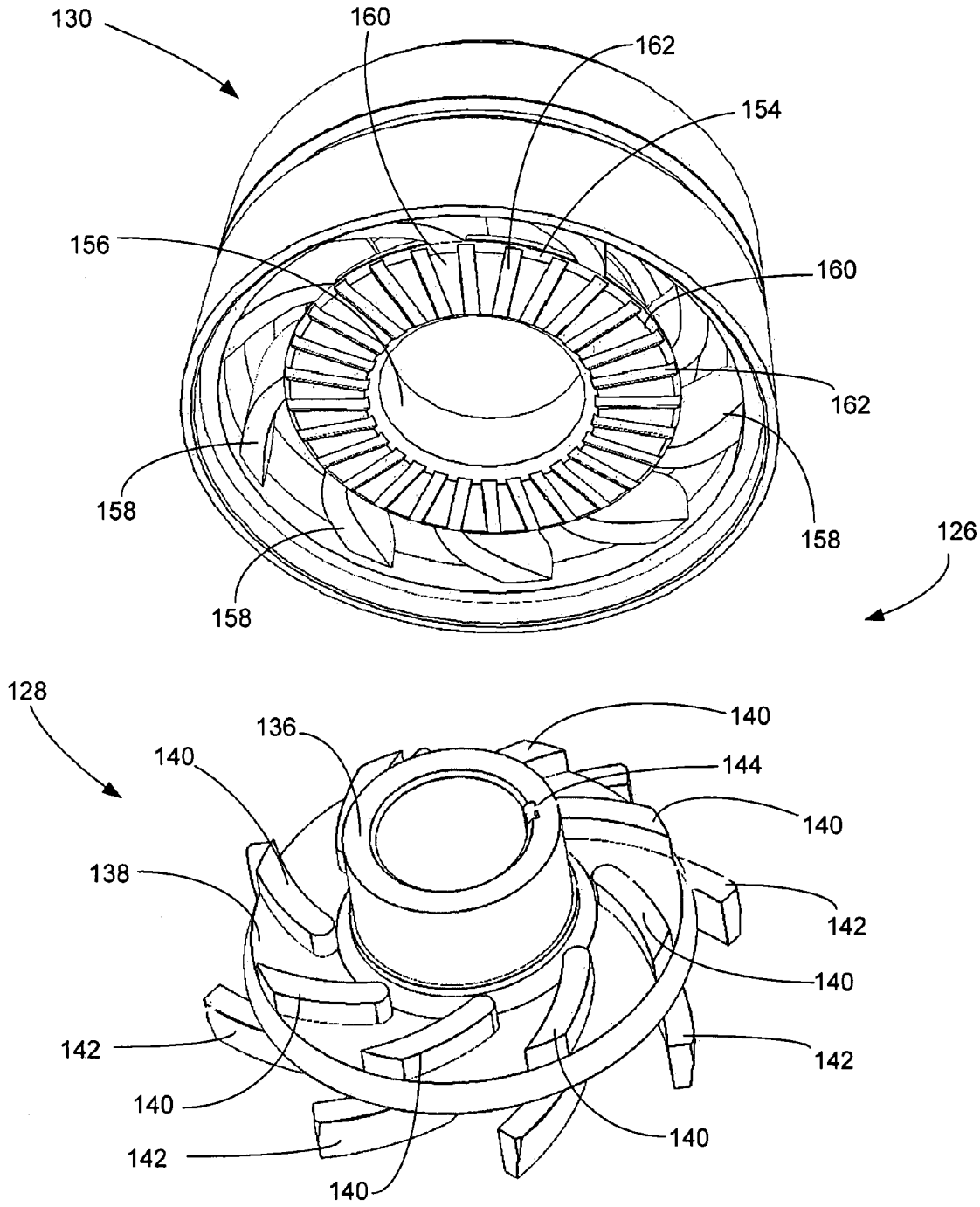
FIG. 4 is an exploded perspective view of the upper side of an impeller and the lower side of an adjacent diffuser of the grinder pump assembly of FIG. 2.

The impeller 128 preferably includes a hub 136, a vane support 138, a plurality of upper vanes 140 and a plurality of lower vanes 142. The hub 136 preferably includes a slot 144 for engagement with a corresponding key (not shown) on the shaft 134 (also not shown in FIG. 3). The vane support 138 is connected to the hub 136. The upper vanes 140 and lower vanes 142 are connected to opposite sides of the vane support 138. In a particularly preferred embodiment, each of the upper vanes 140 extend in an arcuate fashion along the top side of the vane support 138 from the hub 136 to the outer diameter of the vane support 138. The lower vanes 142 preferably extend in a similar arcuate fashion from the hub 138 along the bottom side of the vane support 138 beyond the edge of the vane support 138. In this way, lower vanes 142 are longer than upper vanes 140. Although eight upper and lower vanes 140, 142 are shown in FIGS. 3 and 4, it will be appreciated that fewer or greater numbers of upper and lower vanes 140, 142 could also be used. Additionally, it may be desirable in certain applications to use fewer or greater numbers of upper vanes 140 than lower vanes 142. Furthermore, although multiple grinder pump stages 126 are presently preferred, a single grinder pump stage 126 may be useful in certain applications.

The upper side of the diffuser 130 preferably includes a cup 146 of sufficient size diameter and depth to accept with small tolerances the lower vanes 142 of the impeller 128. The surface of the cup 146 includes a plurality of upper contact surfaces 148 and upper flow channels 150. As shown in FIG. 3, the upper contact surfaces 148 and upper flow channels 150 cover both the horizontal and vertical surfaces of the cup 146 in the diffuser 130. The diffuser 130 also includes an upper aperture 152 disposed at the center of the bottom portion of the cup 146.

Turning to FIG. 4, shown therein is an exploded perspective view of the lower side of a diffuser 130 and the upper side of an impeller 128. On its lower side, the diffuser 130 includes a lower face 154, a lower aperture 156 disposed therein and a plurality of diffuser vanes 158 extending outward from the lower face 154. The lower face 154 includes a plurality of lower contact surfaces 160 and lower flow channels 162. The lower face 154 is preferably sized in approximate congruence with the vane support 138 and the lower aperture 156 is configured to accept the upper portion of the hub 136. In this way, the upper vanes 140 rotate in close proximity with the lower contact surfaces 160.

Figure 5:
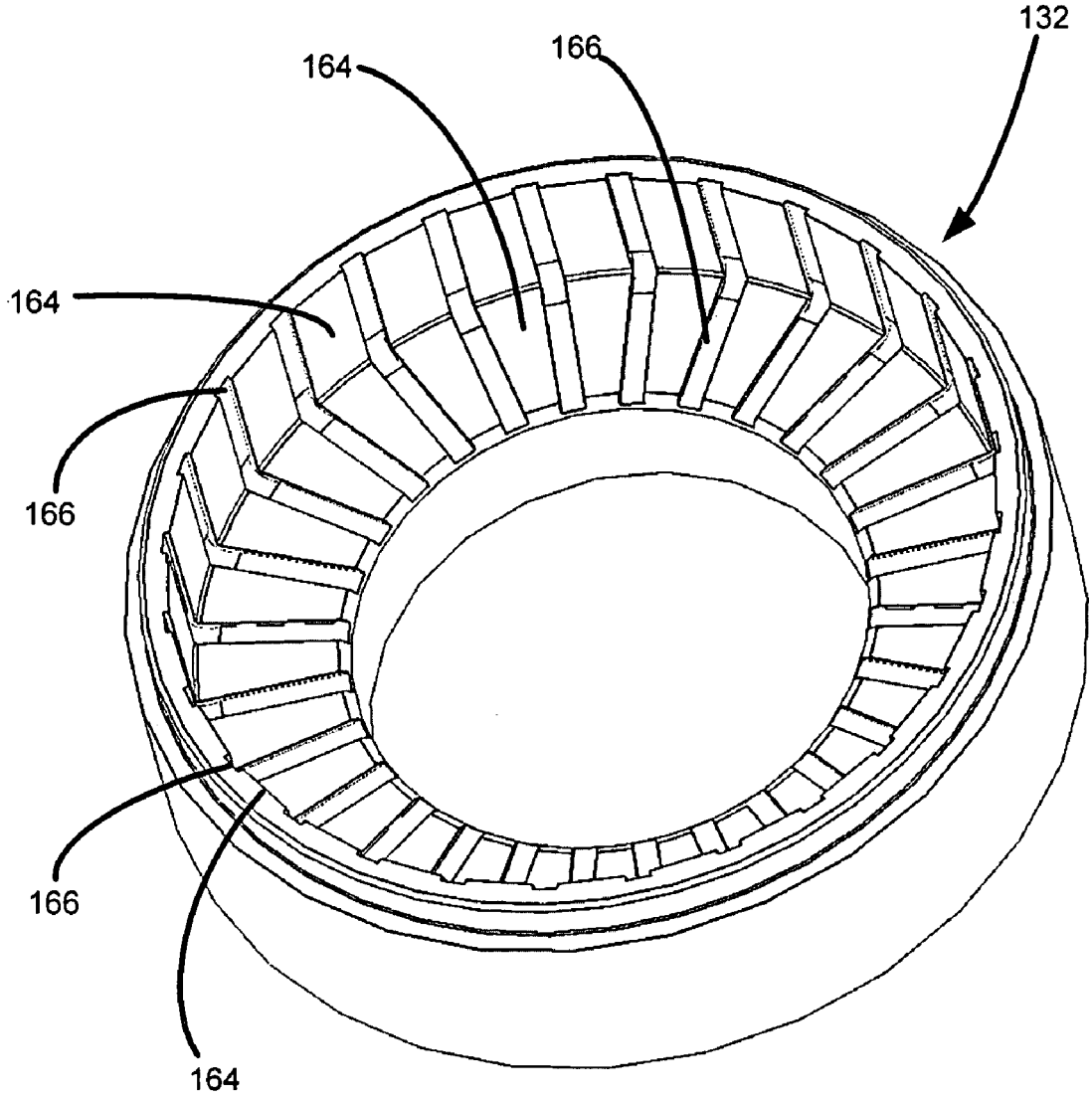
FIG. 5 is a perspective view of the top side of a diffuser cap from the grinder pump assembly of FIG. 2.

Turning to FIG. 5, shown therein is a top perspective view of the diffuser cap 132. As shown in FIG. 2, the diffuser cap 132 is configured to be connected at the upstream end of the grinder pump assembly 114. The diffuser cap 132 includes cap contact surfaces 164 and cap flow channels 166 and is configured to surround the lower vanes 142 of the impeller 128 closest to the intake ports 124.

Each grinder pump stage 126 is preferably constructed from a hardened metal alloys. Suitable alloys are available from Haynes International, Inc. under the "Hastelloy" trademark. It will be understood that the number of grinder pump stages 126 within the grinder pump assembly 114 can be adjusted to meet the degree of pulverization required for a particular well fluid condition.

In the preferred embodiment, well fluid and entrained solid particles enter the grinder pump assembly 114 through the intake ports 124. The fluid passes in a downstream direction through the diffuser cap 132 where the lower vanes 142 of the upstream impeller 128 grind the solid particles against the cap contact surfaces 164. Pulverized particles and fluid pass through the cap flow channels 166 around the vane support 138 and into the upper vanes 140. The upper vanes 140 grind solid particles against the lower contact surfaces 160 on the lower face 154 of the adjacent downstream diffuser 130. The fluid and pulverized particles pass through the lower flow channels 162 into the diffuser vanes 158 and into the cup 146 on the downstream side of the diffuser 130. The lower vanes 142 of the subsequent downstream impeller 128 (if one is used) grind remaining solid particles against the upper contact surfaces 148 of the cup 146.

If multiple grinder pump stages 126 are used, it may be desirable to modify the geometry of the contact surfaces and flow channels and the tolerances between the vanes of the impellers 128 and the contact surfaces to produce a graduated pulverization effect. If graduated pulverization is desired, the spacing between adjacent contact surfaces and between the contact surfaces and impeller vanes should be sequentially decreased at each grinder pump stage 126 from the upstream portion of the grinder pump assembly 114 to the downstream portion of the grinder pump assembly 114.

It is to be understood that even though numerous characteristics and advantages of various embodiments of the present invention have been set forth in the foregoing to description, together with details of the structure and functions of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. It will be appreciated by those skilled in the art that the teachings of the present invention can be applied to other systems without departing from the scope and spirit of the present invention.

What is claimed is:

1. A grinder pump assembly comprising:

a plurality of diffusers, wherein each of the plurality of diffusers comprises:

a lower face having a plurality of lower contact surfaces and lower flow channels;

a plurality of diffuser vanes; and a cup having upper contact surfaces and upper flow channels;

an impeller having a plurality of upper vanes, wherein the upper vanes are configured to rotate in proximity with the lower contact surfaces on the lower face; and a diffuser cap positioned upstream of the impeller, wherein the diffuser cap includes cap contact surfaces and cap flow channels.

2. The grinder pump assembly of claim 1, further comprising a plurality of impellers, wherein each of the plurality of impellers is positioned between a first adjacent diffuser and a second adjacent diffuser, and wherein each of the plurality of impellers comprises:

a vane support;

a plurality of upper vanes, wherein the plurality of upper vanes are configured to rotate in close proximity with the lower contact surfaces of the first adjacent diffuser; and a plurality of lower vanes, wherein each of the plurality of lower vanes is configured to rotate in close proximity with the upper contact surfaces of the second adjacent diffuser.

3. A downhole pumping system comprising:

a motor;

a seal section connected to the motor;

a primary pump assembly powered by the motor; and a grinder pump assembly connected between the seal section and the primary pump assembly, wherein the grinder pump assembly comprises:

a plurality of diffusers, wherein each of the plurality of diffuser comprises:

a lower face having a plurality of lower contact surfaces and lower flow channels;

a plurality of diffuser vanes; and and a cup having upper contact surfaces and upper flow channels; and an impeller, wherein the impeller comprises:

a plurality of upper vanes that are configured to rotate in proximity with the lower contact surfaces on the lower face of the diffuser.

4. The downhole pumping system of claim 3, wherein the grinder pump assembly further comprises a diffuser cap positioned upstream of the impeller.

5. The downhole pumping system of claim 3, wherein the grinder pump assembly includes a plurality of impellers, wherein each of the plurality of impellers is positioned between a first adjacent diffuser and a second adjacent diffuser, and wherein each of the plurality of impellers comprises:

a vane support;

a plurality of upper vanes, wherein the plurality of upper vanes are configured to rotate in close proximity with the lower contact surfaces of the first adjacent diffuser; and a plurality of lower vanes, wherein each of the plurality of lower vanes is configured to rotate in close proximity with the upper contact surfaces of the second adjacent diffuser.

* * * * *